US008863981B1

(12) United States Patent
Fontaine

(10) Patent No.: US 8,863,981 B1
(45) Date of Patent: Oct. 21, 2014

(54) PAINT CONTAINER SUPPORT DEVICE

(76) Inventor: Norston Lin Fontaine, Plymouth, MN (US)

( * ) Notice: Subject to any disclaimer, the term of this patent is extended or adjusted under 35 U.S.C. 154(b) by 627 days.

(21) Appl. No.: 12/804,100

(22) Filed: Jul. 14, 2010

Related U.S. Application Data

(60) Provisional application No. 61/271,032, filed on Jul. 16, 2009.

(51) Int. Cl.
*B65D 25/28* (2006.01)

(52) U.S. Cl.
USPC ..... 220/755; 220/759

(58) Field of Classification Search
USPC ..... 220/755, 759, 756, 776; 248/211
See application file for complete search history.

(56) References Cited

U.S. PATENT DOCUMENTS

| | | | | |
|---|---|---|---|---|
| 4,053,131 | A * | 10/1977 | Francis | 248/211 |
| 4,993,767 | A * | 2/1991 | Song | 294/31.1 |
| 5,584,520 | A * | 12/1996 | Niemeier | 294/34 |
| 6,585,204 | B1 * | 7/2003 | Haertzen | 248/211 |
| 2006/0260081 | A1 * | 11/2006 | Frassinelli et al. | 15/220.4 |
| 2008/0054030 | A1 * | 3/2008 | Diaz | 224/148.7 |

* cited by examiner

*Primary Examiner* — Stephen Castellano
(74) *Attorney, Agent, or Firm* — Pauly, DeVries Smith & Deffner, LLC

(57) ABSTRACT

A support device for use with paint containers with wire bail handles. The support device allows a user to safely and easily hang a paint container from the step of a ladder. The support device includes a ladder rung hook member attached to the upper portion of the device handle. The handle is attached to a body portion. The lower portion of the body contains a wire bail catch feature, and support wall that contacts the side of the paint container. The device supports a paint container in a downward angle to better facilitate user access to the contents of the paint container. The device quickly attaches to a paint container.

13 Claims, 9 Drawing Sheets

14
10
18
16
28
27
26
32

38
36
14
18
10
38
27
26
34
36

PAINT CONTAINER SUPPORT DEVICE

This application claims priority to U.S. Provisional Application No. 61/271,032 filed Jul. 16, 2009.

FIELD

This invention relates in general to devices used for supporting paint containers.

BACKGROUND

This invention is used for supporting a paint container with a wire or plastic bail handle. One such example of a paint container with a wire or plastic bail handle is the ubiquitous one gallon paint can, including its metric sized equivalent. Besides paint and primer, these containers are also widely used for holding mastic, roofing cement, epoxy, and other materials.

Many users find it faster and more convenient to paint directly from the paint container. However, painting from the paint container creates a number of vexing problems. One problem is that holding the wire bail handle is uncomfortable, and may cause severe hand strain in a short amount of time. Another problem is that the container's wire bail handle naturally positions one of the user's hand directly over the top of the container's opening, creating an obstruction which makes it difficult to insert paint brushes and other tools into the opening. Yet another problem is that a paint container has no built-in provisions to allow it to hang from a ladder without the aid of an additional device. Furthermore, many modern step type and multi-purpose type ladders are no longer fitted with factory tool trays, an accessory that provides a surface from which to rest the paint container. Lastly, paint container have no provisions to hold a paint brush.

SUMMARY

The general purpose of this novel invention is to solve the problems associated with painting from a paint container. Accordingly, this device makes it more comfortable for the user to hold the paint container, especially for an extended period of time. This device also provides a new and improved hand-hold position, which allows the user easier access to the contents of the container. Furthermore, this device facilitates and enables safe and quick attachment of the paint container to most common ladders on the market today. This device also provides a means for holding a paint brush and other tools. Finally, attachment and removal of the device to the paint container is quick and easy, and requires no special tools.

DRAWINGS

While the drawings above illuminate some various embodiments of the invention, other embodiments are also contemplated. Numerous other modifications and embodiments can be devised by those skilled in the art which fall within the scope and spirit of the principles of this invention.

DETAILED DESCRIPTION

Figure 1:
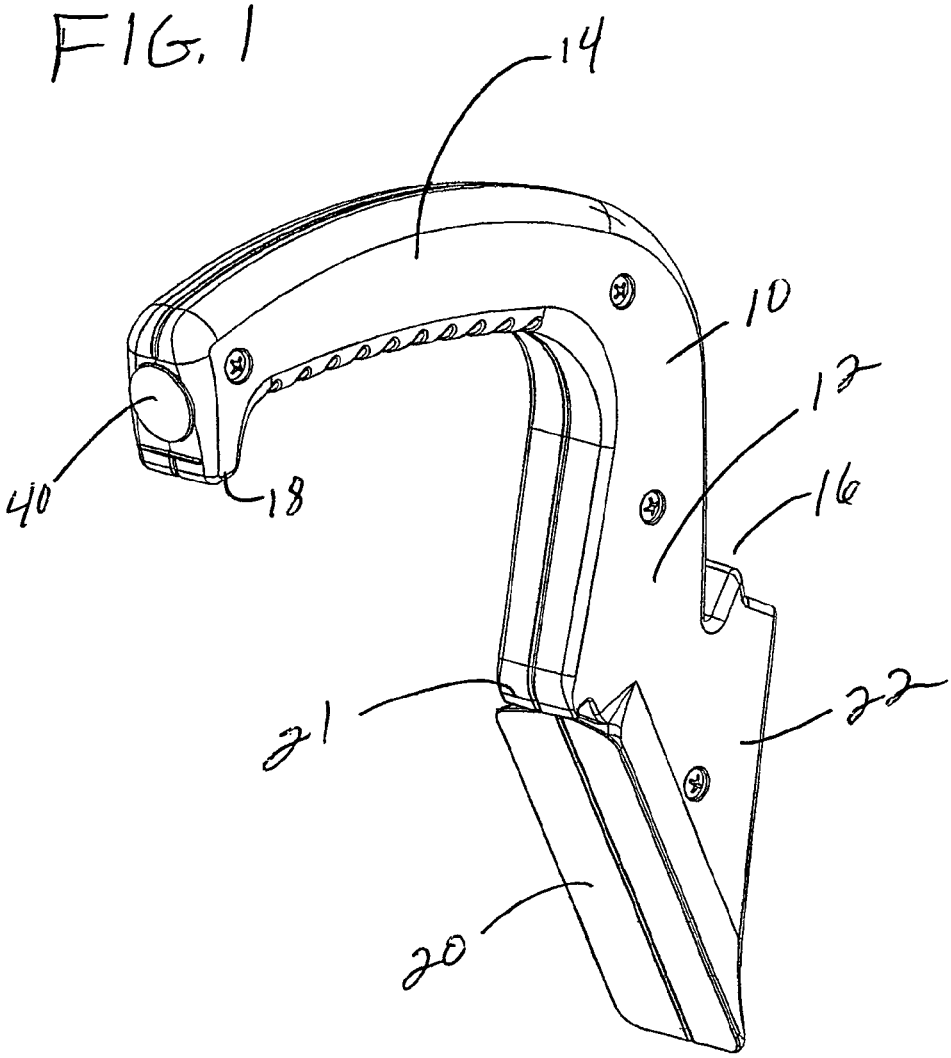
FIG. 1 is a front perspective view of the invention.

FIG. 1 shows one embodiment of the paint container support device in accordance with the present invention. The handle 14 of the device 10 is attached to the upper portion of the body 12, and the support wall 20 is attached to the lower portion of the body 12. The hook member 18 is attached to the upper portion of the handle 14. A magnet 40 is attached to the upper portion of the handle 14. The wire bail catch feature 16 is located on the rear portion 22 of the body 12.

Figure 2:
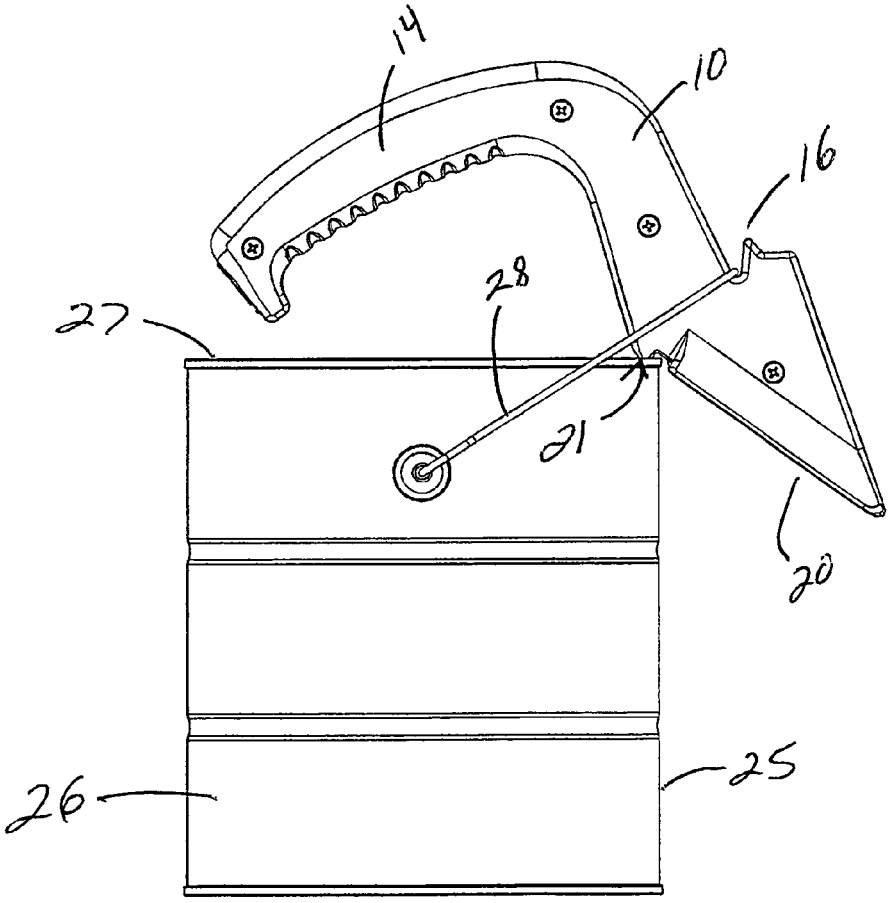
FIG. 2 is a side view of the invention and a paint container.
Figure 3:
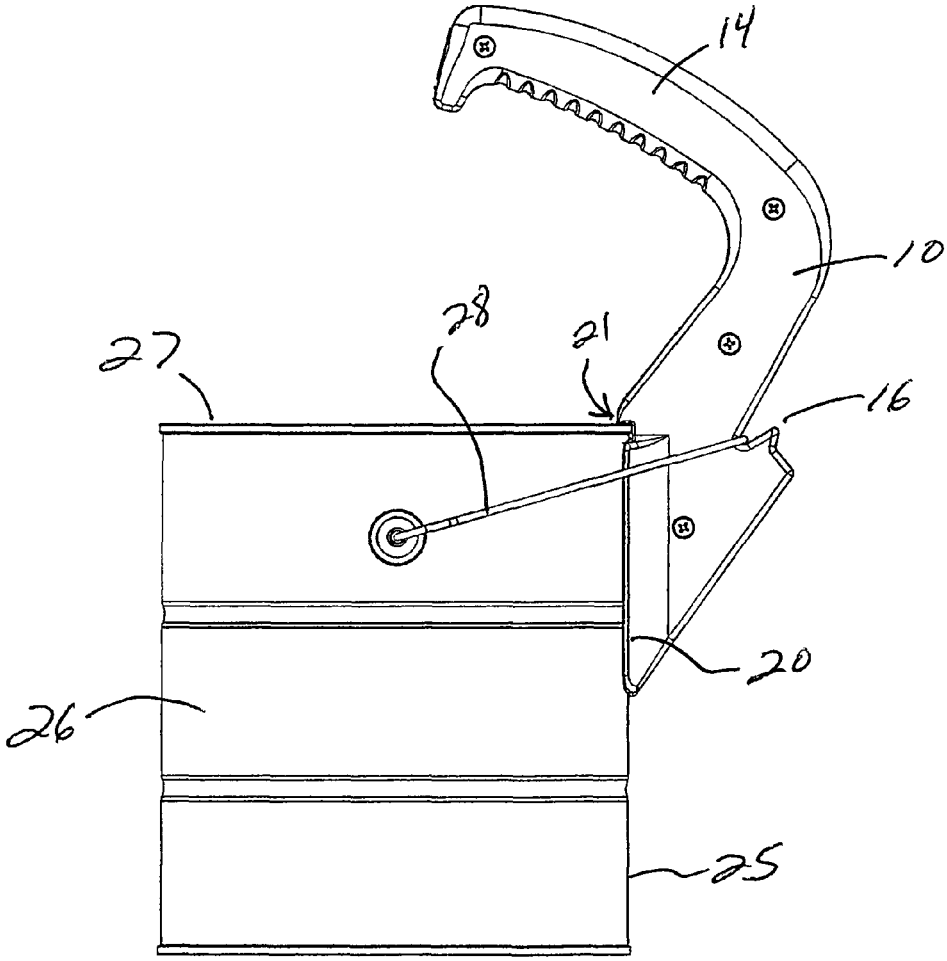
FIG. 3 is a side view of the invention and a paint container.

The device 10 quickly and easily attaches to a paint container 26, hereinafter container 26, without the use of other tools. To attach the device 10, the user first positions it on the container 26, as shown in FIG. 2. Here, the wire bail 28 is shown already engaged with the wire bail catch feature 16, and the stop feature 21 is contacting the top rim 27 of the container 26. Next, the user grasps the handle 14 and tilts it backwards until the support wall 20 is contacting the side wall 25 of the container 26, as shown in FIG. 3. As the user is tilting the handle 14 backwards, the wire bail 28 will come under increasing tension until the device 10 is fully attached to the container 26, at which point the tension in the wire bail 28 may diminish. When the user lifts the handle 14 the support wall 20 will lift upward along the side the container 26, and tension will increase on the wire bail 28.

To remove the device 10 from the container 26, the user simply grasps the handle 14 and tilts it forward until the wire bail 28 is no longer in tension. The user then disengages the wire bail 18 from the wire bail catch feature 16, which will then allow the device to be removed from the container 26. It should be noted that the container's 26 factory supplied lid may be in place or removed from the container 26 prior to attaching or removing the device 10 from the container 26. Furthermore, the container's 26 factory lid may be removed and reinstalled when the device 10 is attached to the container 26.

As shown in the FIG. 1, the stop feature 21 is positioned near the upper portion of the support wall 20. In this particular embodiment of the invention, the stop feature 21 protrudes forward of the support wall 20 a predetermined distance, which is sufficient to make contact with the top rim 27 of the container 26, and still allow for removal and resealing of the container's 26 lid. The stop feature 21 can be used as a pivot point during the attachment of the device 10 to the container 26. As shown in FIG. 3, the stop feature 21 also positions the device 10 on the container 26 to a predetermined height, which allows the wire bail catch feature 16 to be structured in cooperation with the support wall 20, such that an upward movement of the support wall 20 will load the wire bail 28 in tension. Also visible in FIG. 3, the wire bail catch feature 16 is configured to engage the wire bail 28 below the stop feature 21 when the support wall 20 is in a substantially vertical position.

After the device 10 is attached to the container 26, the original wire bail 28 handle is no longer used as the primary hand-hold. Instead, the handle 14 on the device 10 becomes the new and preferred hand-hold for the container 26. The new hand-hold positions the user's hand further away from the container's 26 opening than the original wire bail 28 handle. Also, whereas the original wire bail 28 handle position is centered over the opening of the container 26, the new hand-hold position is offset rearward from the opening of the container 26. The new hand-hold position established by the device 10 is much less obtrusive than the position established by container's original wire bail handle, and thereby provides the user with much improved access to the contents of the container 26.

Figure 4:
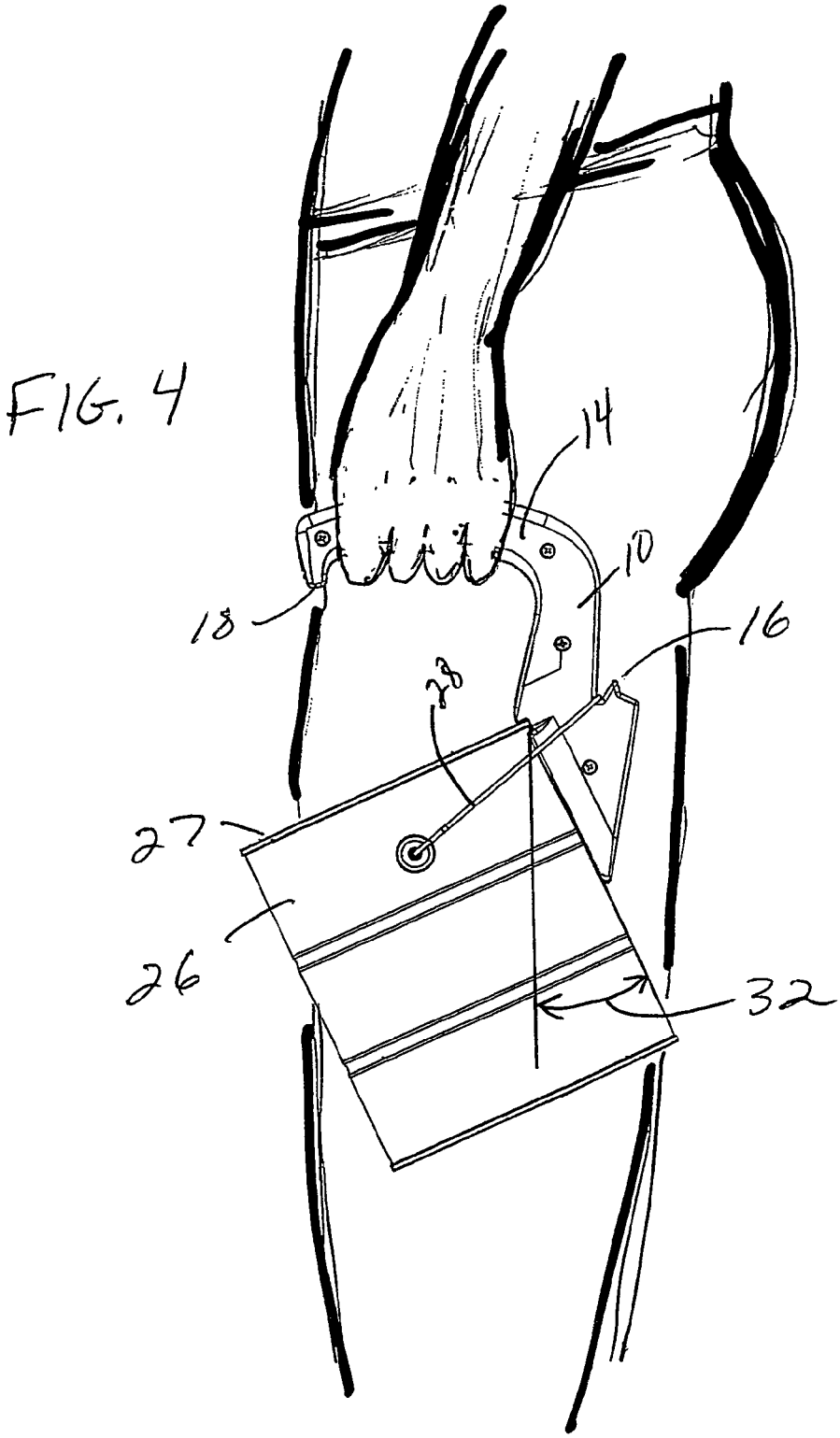
FIG. 4 is a side view of the invention and a paint container.

When the user holds the container 26 from the wire bail 28, without use of the device 10, the container 26 is naturally held in an upright position. However, when the user holds the container from the handle 14 of the device 10, the structure of the device 10 supports the container 26 at a downward angle 32, as shown in FIG. 4. The device 10 supports the container 26 at a position less than vertical, making it easier for the user to insert a paint brush and other tools into the opening of the container 26. Furthermore, use of the device 10 increases the distance between the user's hand and the top rim 27 of the container 26, again, making it easier for the user to insert a paint brush and other tools into the container 26. In this particular embodiment, the downward angle 32 shown in FIG. 4 is approximately twenty-five degrees less than vertical. However, the device 10 may be structured to hold the container 26 in other positions suitable for easy access to the contents of the container 26. FIG. 4 additionally shows that the wire bail catch feature 16 is configured to engage the wire bail 28 below a plane defined by the top rim 27 of the container 26.

Figure 5:
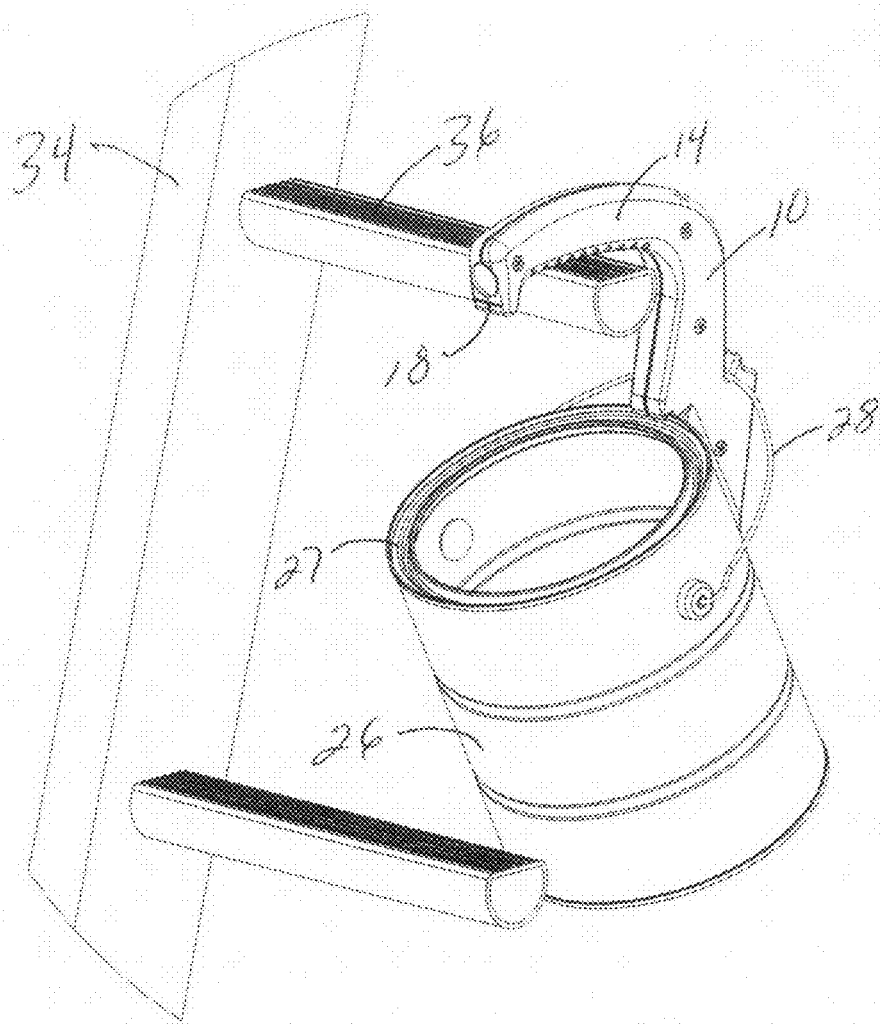
FIG. 5 is a front perspective view of the invention hanging from a ladder.

FIG. 5 shows the device 10 attached to the container 26, and hanging from the rung or step 36 of a ladder 34, hereinafter step 36. As shown in FIG. 5, the hook member 18 is engaged with the step 36. The general shape of the hook member 18 helps to prevent the device 10 from slipping off the step 36. The shape of the hook member 18 will also help to prevent the user's hand from sliding off the upper portion of the handle 14. The design of the device 10 also makes it suitable for hanging from structures other than ladders, such as railings, tables, roof trusses, construction members, ledges, towel bars, etc. The shape of the hook member 18 can be easily modified to fit specific structures, as so needed.

Figure 6:
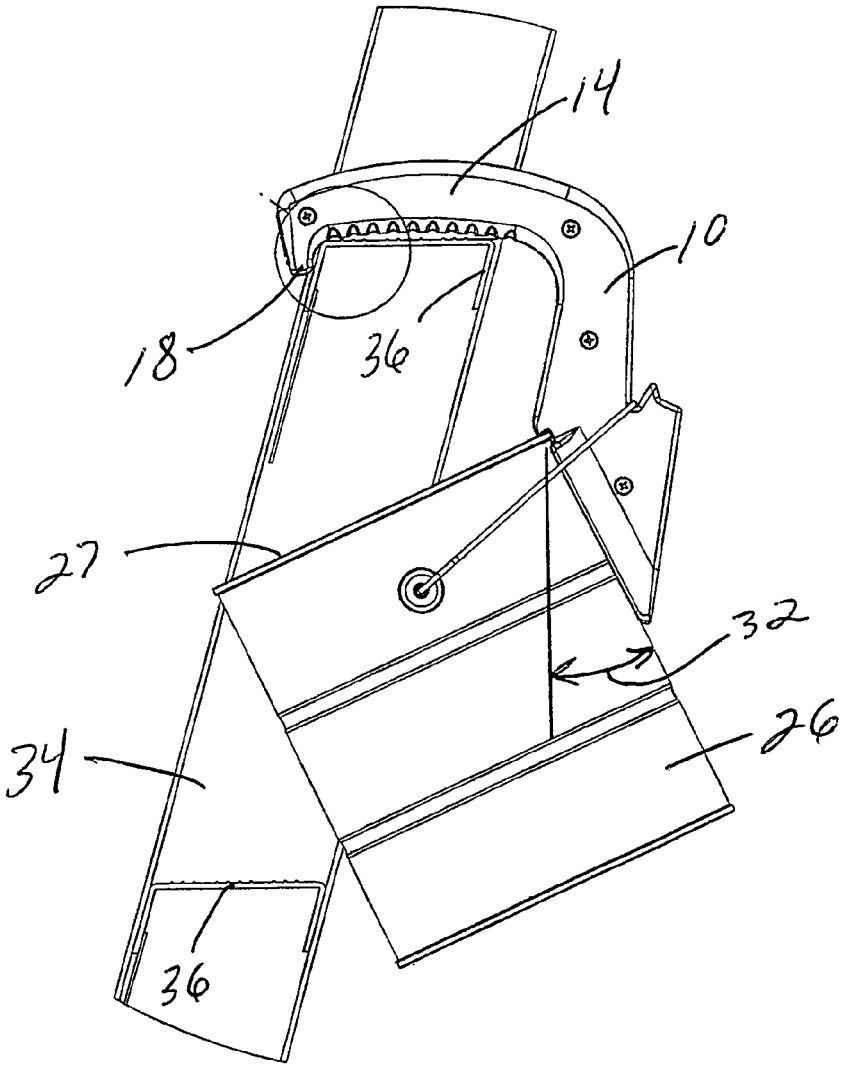
FIG. 6 is a side view of the invention hanging from a ladder.
Figures 7, 8:
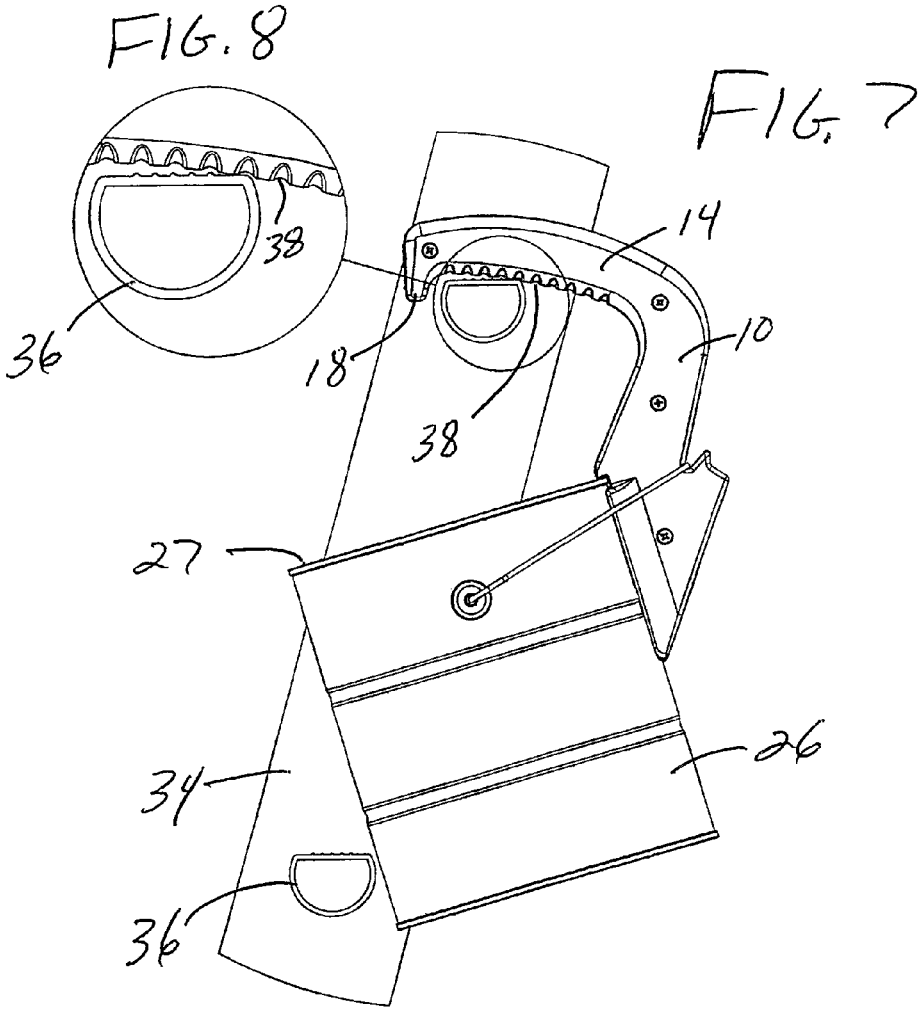
FIG. 7 is a side view of the invention hanging from a ladder.
FIG. 8 is a side view enlargement of the invention hanging from the step of a ladder.

As shown in FIG. 6, the structure of the device 10 positions the container 26 at a downward angle 32 of about twenty-five degrees. As shown in FIGS. 5-7, the top rim 27 of the container 26 is tilted towards the front, or top side, of the ladder 34, and this provides the user better access to the contents of the paint container 26, especially for inserting brushes, hands, and tools into the container 26.

FIG. 6 shows a side view of the device 10 attached to a typical step ladder 34. As shown in the figure, the hook member 18 is engaging the step 36, and this helps prevent the device 10 from falling off the ladder 34, thereby reducing the potential for serious property damage and bodily harm. The hook member 18 also helps to prevent the user from accidentally pushing the device 10 off the ladder 34 while in use. Although the device 10 is shown in this figure with a typical step type ladder 24, the shape of the hook member 18 and length of the handle 14 may be easily modified to fit a particular step 36 shape or type of ladder.

FIG. 7 shows a side view of the device 10 attached to a typical extension ladder 34. The circled area of this figure illustrates where the handle 14 of the device 10 contacts the step 36. FIG. 8 shows an enlarged illustration of the circled area shown in FIG. 7. As shown in FIGS. 7-8, the lower portion of the handle 14 includes a plurality of small ribs, or engagement features 38. These engagement features 38 position and hold the handle 14 in various locations on the step 36, and allow the user to position the container 26 at a specific and suitable downward angle 32.

Figure 9:
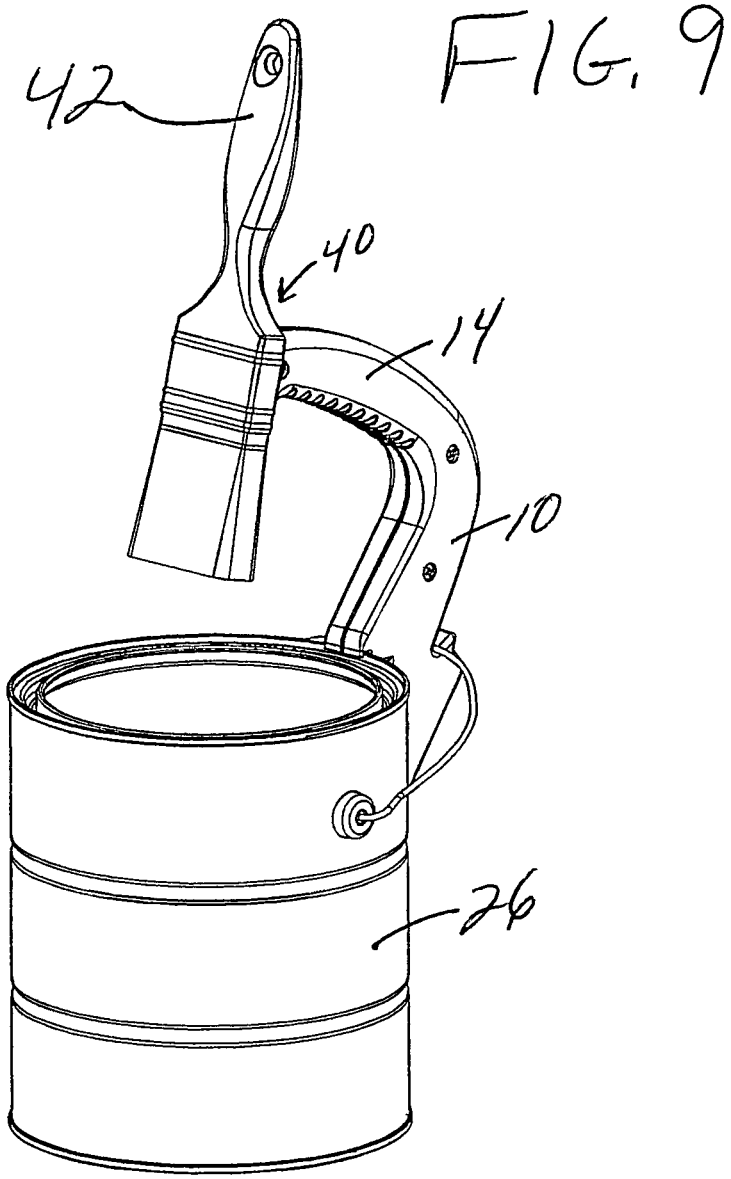
FIG. 9 is a front perspective view of the invention, a paint brush, and a paint container.
Figure 10:
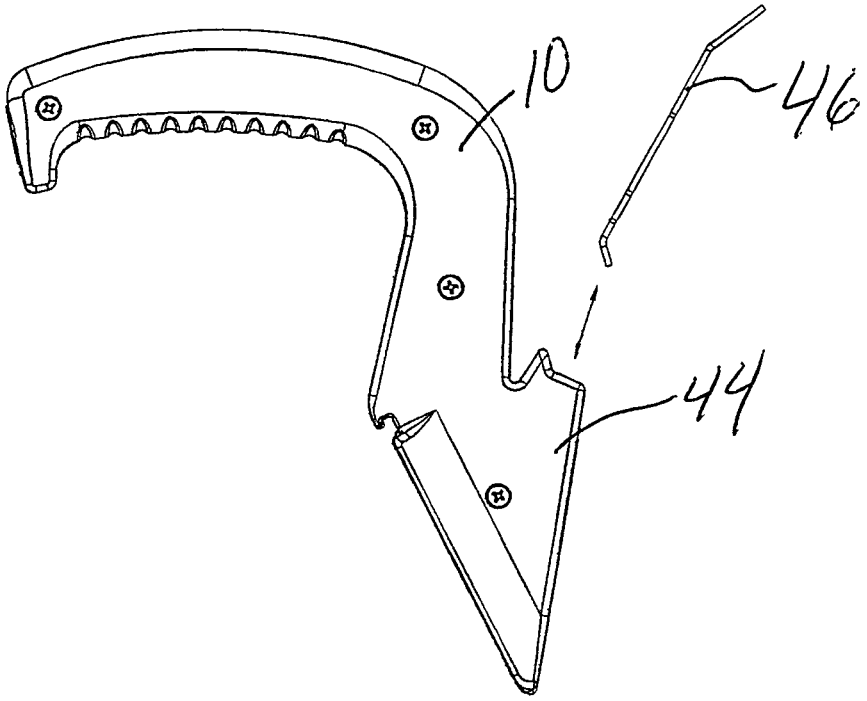
FIG. 10 is a side view of the invention and a paint can opener.

FIG. 9 shows a typical paint brush 42 attached to the magnet 40 located at the upper portion of the handle 14. In the present embodiment, the location of the magnet 40 positions the paint brush over the opening of the container 26 for easy user access to the contents of the container 26, and also allows drips from the paint brush 42 return to the container 26 without creating a mess. The magnet may also be used to hold screw drivers, pliers, scrapers, and other tools and paint sundries. The magnet 40 can be made from any suitable magnetic material. The size and shape of the magnet 40 may vary from the present embodiment FIG. 10 shows a tool holder 44 fixedly attached to the rear portion of the body 18. The basic shape of the tool holder 44, in this particular embodiment, is a pocket. The tool holder 44 could be structured in any number of ways suitable for holding a particular tool. The tool shown in this figure is a side view of a stamped steel paint can opener 46. The tool holder 44 may be used to hold any number of painting related tools, such as scrapers, pry bars, screw drivers, nail pullers, and can or bottle openers. The tool 46 slides into the holder 44 as indicated by the arrow.

It will be obvious to those skilled in the art that modification may be made to the embodiment described above without departing from the scope of the invention as claimed.

I claim:

1. A support device for a container having a wire bail, comprising:

a body having a handle attached to an upper portion of said body;

a hook member attached to said handle;

a support wall configured to contact a portion of an outer side wall of a container, said support wall on a lower, front portion of said body;

a stop member protruding from an upper portion of said support wall, wherein said stop member is configured to define a pivot point between the container and the body; and a wire bail catch means attached to the rear portion of said body, wherein the wire bail catch means is configured to engage a wire bail below the stop member when the support wall is in a substantially vertical position, whereby said wire bail catch means is structured in cooperation with said support wall, such that an upward movement of said handle will load said wire bail in tension.

2. The support device in claim 1, wherein said hook member is shaped to selectively engage the step of a ladder.

3. The support device of claim 2, wherein said downward angle is between one and forty-five degrees past vertical.

4. The support device in claim 1, wherein said handle is positioned to support said container at a downward angle.

5. The support device in claim 1, further comprising a magnet attached to said handle.

6. A support device for a paint container having a wire bail, comprising:

a body;

a handle attached to an upper portion of said body, whereby said handle is positioned to support a container at a downward angle;

a support wall on a lower, front portion of said body, wherein said support wall is configured to contact a portion of an outer side wall of the paint container;

a stop member protruding from an upper portion of said support wall, wherein said stop member is configured to define a pivot point between the paint container and the body; and a wire bail catch means on a rear portion of said body, wherein the wire bail catch means is configured to engage a wire bail below the plane defined by the top rim of the paint container, and whereby said wire bail catch means is structured in cooperation with said support wall, such that an upward movement of said handle will load said wire bail in tension.

7. The support device in claim 6, further comprising a hook member attached to said handle, whereby said hook member is shaped to selectively engage the step of a ladder.

8. The support device in claim 6, further comprising a magnet attached to said handle.

9. The support device of claim 6, wherein said downward angle is between one and forty-five degrees past vertical.

10. The support device of claim 6, wherein the bottom portion of said handle includes a plurality of small rib features shaped to selectively engage the step of a ladder.

11. The support device in claim 6, wherein said body defines a means for holding one or more tools.

12. The support device in claim 6, wherein said stop member is configured to contact an upper rim of said container.

13. A method of supporting a paint container with a wire bail, comprising the steps of:

positioning a wire bail of a paint container in an upright position;

placing said support device of claim 6 under said wire bail until said support device engages said wire bail catch means attached to said rear portion of said support device;

grasping said handle of said support device and tilting said support device rearward until said support wall of said support device is contacting said outer side wall of said paint container and said handle is positioned above said paint container, whereby a user is able to grasp said handle, lift said handle, and support said paint container.

* * * * *